US006168104B1

(12) United States Patent
Lin et al.

(10) Patent No.: US 6,168,104 B1
(45) Date of Patent: Jan. 2, 2001

(54) SHREDDING MODULE USED IN A PAPER SHREDDER

(75) Inventors: Shin-Fu Lin; Yung Feng Wen, both of Taipei Hsien (TW)

(73) Assignee: Primax Electronics Ltd., Taipei Hsien (TW)

( * ) Notice: Under 35 U.S.C. 154(b), the term of this patent shall be extended for 0 days.

(21) Appl. No.: 09/182,292

(22) Filed: Oct. 27, 1998

(30) Foreign Application Priority Data

Sep. 25, 1998 (TW) ..... 87115928

(51) Int. Cl.[7] ..... B02C 18/16
(52) U.S. Cl. ..... 241/236; 241/295
(58) Field of Search ..... 241/236, 295; 83/522, 503

(56) References Cited

U.S. PATENT DOCUMENTS 5,025,994 * 6/1991 Maitlen et al. ..... 241/236
5,048,767 * 9/1991 Mori ..... 241/236
5,292,078 * 3/1994 Lodovico et al. ..... 241/236
5,511,732 * 4/1996 Kroger et al. ..... 241/236
5,676,321 10/1997 Kroger .

* cited by examiner

*Primary Examiner*—Mark Rosenbaum
(74) *Attorney, Agent, or Firm*—Winston Hsu

(57) ABSTRACT

The present invention provides a shredding module of a paper shredder that can cut more paper with less noise. The shredding module comprises two parallel rotatable shafts and two sets of circular shredding knives installed separately on the two rotatable shafts. Each of the shredding knives is made by punching a thin metal plate with a punching die. The shredding knife comprises a circular plate with a plurality of saw teeth around its circular edge, a circular recess on the circular plate, and a mounting hole positioned at the center of the circular plate. The peripheral portion of the concave side of each shredding knife is rotatably engaged with the peripheral portion of the concave side of a corresponding shredding knife mounted on the other rotatable shaft for cutting intervening paper. Each of the shredding knives further comprises a sloping edge on the circular edge of the convex side for sharpening the saw teeth so that the shredding module can cut more paper with less noise.

4 Claims, 3 Drawing Sheets

SHREDDING MODULE USED IN A PAPER SHREDDER

BACKGROUND OF THE INVENTION

1. Field of the Invention

The present invention relates to a paper shredder, and more particularly, to a shredding module used in a paper shredder.

2. Description of the Prior Art

A typical paper shredder uses shredding modules to cut paper into thin strips. A shredding module comprises two parallel rotatable shafts rotatably installed inside a paper shredder with two sets of circular shredding knives separately installed on the two parallel rotatable shafts for cutting paper fed through them. A common index of shredding module cutting capability is the maximum number of paper sheets that can be fed and shredded. Shredding a large number of sheets of paper at the same time saves time for the user.

Please refer to FIGS. 1 to 3. FIG. 1 is a perspective view of a prior art shredding module 24. FIG. 2 is a top view of the shredding knife 10 shown in FIG. 1. FIG. 3 is a sectional view along line 3—3 of the shredding knife 10 shown in FIG. 2. The shredding module 24 comprises two parallel rotatable shafts 26 rotatably installed in a paper shredder (not shown) and two sets of circular shredding knives 10 installed separately on the two rotatable shafts. The shredding knives 10 are made by punching a thin metal plate with a punching die. The shredding knife 10 comprises a circular plate with a plurality of saw teeth 12 around its circular edge 14, a circular recess 16 on the circular plate, and a mounting hole 18 positioned at the center of the circular plate for mounting the shredding knife 10 on one of the rotatable shafts.

The circular recess 16 of the shredding knife 10 comprises a convex side 20 and a concave side 22. FIG. 2 is a top view of the convex side 20 of the shredding knife 10. The peripheral portion of the concave side 22 of each shredding knife 10 is rotatably engaged with the peripheral portion of the concave side 22 of a corresponding shredding knife 10 mounted on the other rotatable shafts for cutting the intervening paper. Unfortunately, this type of shredding knife 10 creates a lot of noise while cutting. Also, the cutting capability of the shredding module depends on the thickness of the circular edge so if the number of paper sheets fed into a shredding module is more than the maximum number it is capable of cutting, paper jamming occurs which causes problems in usage and cleaning.

SUMMARY OF THE INVENTION

It is therefore a primary objective of the present invention to provide a shredding module that can generate a given amount of driving power to cut more paper with less noise thus greatly increasing its cutting capability.

In a preferred embodiment, the present invention provides a shredding module comprising:

two parallel rotatable shafts rotatably installed in the paper shredder; and two sets of circular shredding knives installed on the two rotatable shafts separately, each of the shredding knives being made by punching a thin metal plate using a punching die and comprising a circular plate with a plurality of saw teeth around its circular edge for cutting papers, a mounting hole positioned on the center of the circular plate for mounting the shredding knife to one of the rotatable shafts, and a circular recess on the circular plate over which the mounting hole is positioned at the center of the circular recess;

wherein the circular plate of each shredding knife comprises a convex side and a concave side and the concave side of the circular plate is in the same side with the concave side of the circular recess, the peripheral portion of the concave side of each shredding knife is rotatably engaged with the peripheral portion of the concave side of a corresponding shredding knife mounted on the other rotatable shaft for cutting papers passed in between, and wherein each of the shredding knives further comprises a sloping edge on the circular edge of the convex side of the circular plate for reducing the thickness of each of the saw teeth to sharpen the saw teeth.

It is an advantage of the present invention that the shredding module can simultaneously cut more paper with less noise with a given motor driving power. This benefit is derived from the fact that the saw teeth are thinner and thus sharper.

This and other objective of the present invention will no doubt become obvious to those of ordinary skill in the art reading the following detailed description of the preferred embodiment which is illustrated in the various figures and drawings.

BRIEF DESCRIPTION ON THE DRAWINGS

DETAILED DESCRIPTION OF THE PREFERRED EMBODIMENT

Figure 1:
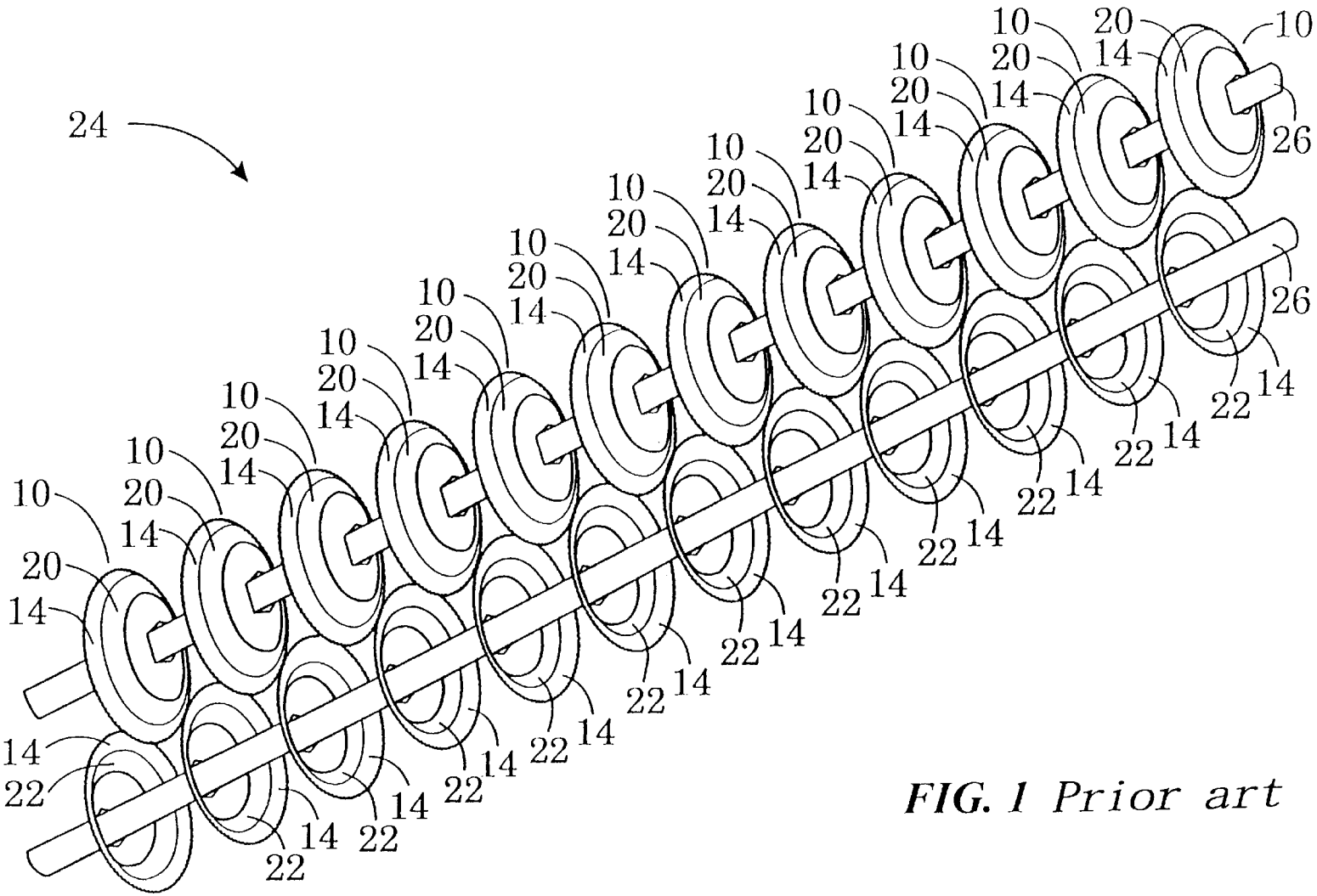
FIG. 1 Prior art
FIG. 1 is a perspective view of a prior art shredding module.
Figure 3:
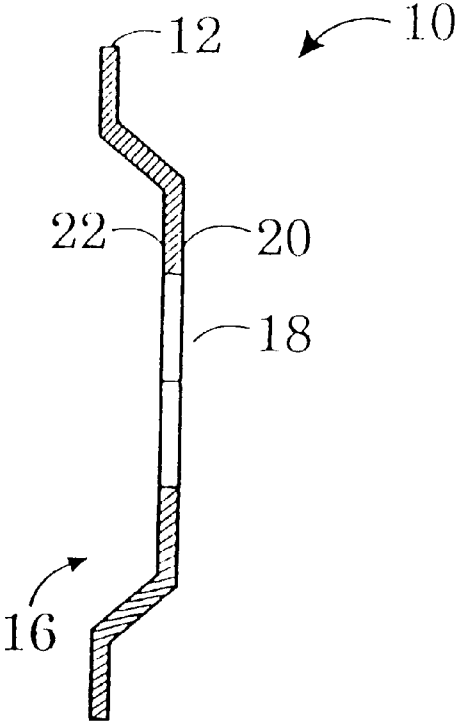
FIG. 3 Prior art
FIG. 3 is a section view along line 3—3 of the shredding knife shown in FIG. 2.
Figure 2:
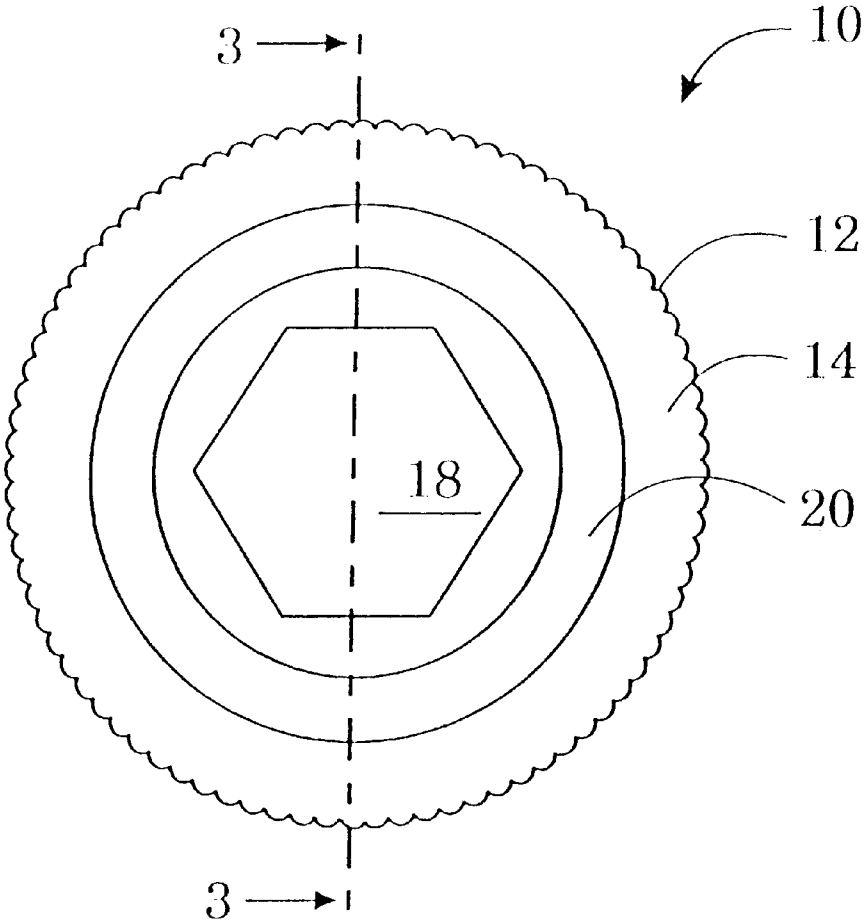
FIG. 2 Prior art
FIG. 2 is a top view of the shredding knife shown in FIG. 1.
Figure 4:
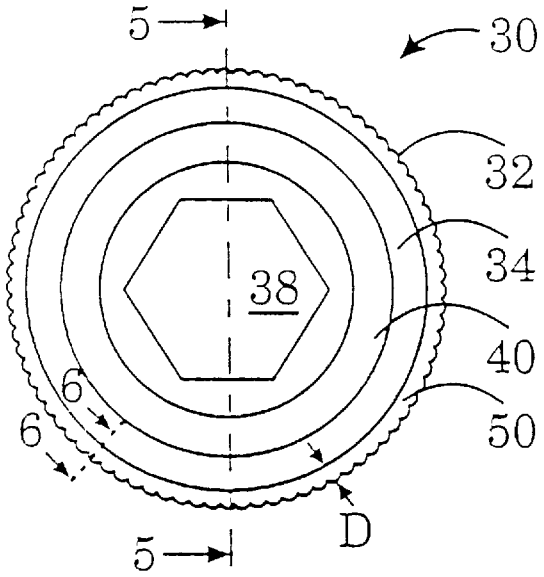
FIG. 4 is a top view of a shredding knife 30 according to the present invention.
Figure 5:
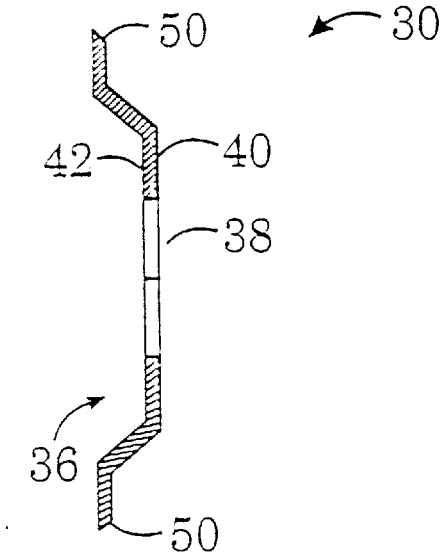
FIG. 5 is a section view along line 5—5 of the shredding knife 30 shown in FIG. 4.
Figure 6:
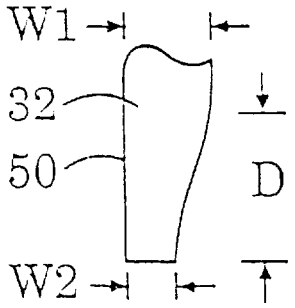
FIG. 6 is a section view along line 6—6 of the shredding knife 30 shown in FIG. 4.

Please refer to FIGS. 4 to 6. FIG. 4 is a top view of a shredding knife 30 according to the present invention. FIG. 5 is a sectional view along line 5—5 of the shredding knife 30 shown in FIG. 4. FIG. 6 is a sectional view along line 6—6 of the shredding knife 30 shown in FIG. 4. The method for assembling shredding knives 30 in a shredding module in the present invention is the same as that shown in FIG. 1. Each of the shredding knives 30 is made by punching a thin metal plate with a punching die. The shredding knife 30 comprises a circular plate with a plurality of saw teeth 32 around its circular edge 34 for cutting paper, a mounting hole 38 positioned at the center of the circular plate for mounting the shredding knife 30 on one of the rotatable shafts, and a circular recess 36 on the circular plate with the mounting hole 38 positioned at its center.

The circular recess 36 comprises a convex side 40 and a concave side 42. FIG. 4 is a top view of convex side 40 of the shredding knife 30. The peripheral portion of the concave side 42 of each shredding knife 30 is rotatably engaged with the peripheral portion of the concave side 42 of a corresponding shredding knife 30 mounted on the other rotatable shaft for cutting intervening paper.

Each of the shredding knives 30 further comprises a sloping edge 50 on the circular edge 34 of the convex side 40 of the circular plate for sharpening the saw teeth 32. The sloping edge 50 is punched onto the metal plate as the shredding knife 30 is made. As opposed to the shredding knife 10, the sloping edge 50 of the shredding knife 30 can be made by altering the punching die, hence the structural design can be achieved at a very low cost.

As shown in FIG. 6, the width of the sloping edge 50 on the convex side 40 of the shredding knife 30 is designated as D, the thickness of the metal plate is designated as W1, and the thickness of the sharpened saw tooth 32 is designated as W2. D of the sloping edge 50 is about one to four times the width W1 of the metal plate, and W2 of the sharpened saw teeth 32 is about ¼ to ¾ of the width W1 of the metal plate. Comparing shredding knife 10 to shredding knife 30, shredding knife 30 is sharper because W2 of shredding knife 30 smaller. Therefore, with the same motor driving power, the resistance during cutting is reduced so that the shredding knives 30 can cut more sheets of paper with less noise.

In the present invention, the maximum number of paper which can be cut at one time under the same motor driving power is increased and the noise produced during cutting is reduced by designing a sloping edge on the convex side of the circular edge of the shredding knife with no change in the power output or the structure of the rotatable shafts. This structural design of the present invention can enhance the cutting capacity and lower the noise of a paper shredder at a very low cost.

Those skilled in the art will readily observe that numerous modifications and alterations of the device may be made while retaining the teachings of the invention. Accordingly, the above disclosure should by construed as limited only by the metes and bounds of the appended claims.

What is claimed is:

1. A shredding module used in a paper shredder comprising:

two parallel rotatable shafts rotatably installed in the paper shredder; and two sets of circular shredding knives installed on the two rotatable shafts separately, each of the shredding knives being made by punching a thin metal plate using a punching die and comprising a circular plate with a plurality of saw teeth around its circular edge for cutting papers and a mounting hole positioned on the center of the circular plate for mounting the shredding knife to one of the rotatable shafts;

wherein the circular plate of each shredding knife comprises a first side and a second side, a peripheral portion of the second side of each shredding knife is rotatably engaged with a peripheral portion of the second side of a corresponding shredding knife mounted on the other rotatable shaft for cutting papers passed in between, and wherein each of the shredding knives further comprises a sloping edge on the circular edge of the first side of the circular plate for sharpening the saw teeth so that the shredding module can cut more papers with less noise.

2. The shredding module of claim 1 wherein each of the shredding knives further comprises a circular recess on the circular plate over which the mounting hole is positioned at the center of the circular recess, and wherein the concave side of the circular recess is in the same side with the second side of the circular plate.

3. The shredding module of claim 1 wherein the thickness of each of the sharpened saw teeth is about ¼ to ¾ of the thickness of the metal plate used for making the circular shredding knife.

4. The shredding module of claim 1 wherein the width of the sloping edge over the first side of the circular plate is about one to four times of the thickness of the metal plate used for making the circular shredding knife.

* * * * *